United States Patent [19]

Zetah

[11] Patent Number: 5,054,416

[45] Date of Patent: Oct. 8, 1991

[54] BOAT ANCHOR WITH FLUKE RELEASE AND RESET MECHANISM

[76] Inventor: Richard H. Zetah, 5665 NE. River Rd., Sauk Rapids, Minn. 56379

[21] Appl. No.: 553,567

[22] Filed: Jul. 18, 1990

[51] Int. Cl.[5] ..... B63B 21/38

[52] U.S. Cl. ..... 114/310; 114/304; 294/82.34

[58] Field of Search ..... 114/310, 304; 294/82.34

[56] References Cited

U.S. PATENT DOCUMENTS

| | | | |
|---|---|---|---|
| 520,177 | 5/1894 | Clark | 114/310 |
| 2,415,605 | 2/1947 | Newby . | |
| 2,631,882 | 3/1953 | Satre | 294/82.34 |
| 2,709,980 | 6/1955 | Christie . | |
| 2,797,658 | 7/1957 | Doty, Jr. . | |
| 2,994,292 | 8/1961 | Winslow | 114/310 |
| 3,762,357 | 10/1973 | Ehrhardt . | |
| 4,380,207 | 4/1983 | Nolt . | |
| 4,632,443 | 12/1986 | Miller et al. | 294/82.34 |

FOREIGN PATENT DOCUMENTS

| | | | |
|---|---|---|---|
| 3801483 | 9/1989 | Fed. Rep. of Germany | 294/82.34 |
| 2066192 | 7/1981 | United Kingdom | 114/310 |

*Primary Examiner*—Sherman Basinger
*Assistant Examiner*—Thomas J. Brahan
*Attorney, Agent, or Firm*—Fleit, Jacobson, Cohn, Price, Holman & Stern

[57] ABSTRACT

An elongated shank is provided having first and second end portions. A pair of anchor flukes are pivotally supported from the first end portion on opposite sides thereof and a latch member and operator are mounted from the shank for movement longitudinally thereof with a lost motion connection provided between the latch operator and latch member. Cam-type stops are carried by the flukes and engagable by the latch member to releasably limit swinging of the flukes relative to the shank between positions angulated at least generally 30 degrees on either side of centered positions generally paralleling the shank and extending toward the second end portion thereof and also engagable with the latch member to cam the latter to its release position from its applied position upon return of the flukes past the stops toward their centered positions. Heavy spring structure yieldingly biases the shank operator toward its applied position and light spring structure yieldingly biases the latch member, toward the applied position relative to the shank operator. The latch member is shiftable by the cam-type stops from the applied position to the release position against the biasing action of the light spring independent of movement of the latch operator relative to the shank. The latch operator includes a portion thereof adjacent the second end of the shank to which one end of an anchor line may be attached.

5 Claims, 2 Drawing Sheets

BOAT ANCHOR WITH FLUKE RELEASE AND RESET MECHANISM

BACKGROUND OF THE INVENTION

1. Field of the Invention

This invention relates generally to boat anchors and more particularly to anti-fouling anchors provided with pivoted flukes and deactivatable stop means for the flukes whereby the flukes may swing to positions angularly displaced at least generally 30 degrees to either side of centered positions thereof with the anchor flukes paralleling the anchor shank and extending toward the upper end thereof, the flukes when the stop structure is deactivated, being swingable to positions angularly displaced at least generally 135 degrees from the centered positions of the flukes.

2. Description of Related Art

Various different forms of anti-fouling anchors heretofore have been provided such as those disclosed in U.S. Pat. Nos. 2,415,605, 2,709,980, 2,797,658, 3,762,357, and 4,380,207. However, none of these previously known anti-fouling anchors are constructed in a manner which enables the anchor to hold against a relatively heavy pull and yet allows the anchor to be reset after the flukes once been released without lifting the anchor to the surface and manually resetting the flukes thereof. Accordingly, a need exist for an anti-fouling, pivoted fluke-type anchor including features thereof which enable the flukes to be reset without pulling the anchor to the surface of the associated body of water.

SUMMARY OF THE INVENTION

Many different forms of anti-fouling boat anchors or anchors equipped with releasable flukes heretofore have been provided. However, most anti-fouling anchors are equipped with deactivatable stop structure for limiting pivoting of the flukes and with the associated anchor line having one end thereof attached to the releasable stop structure in a manner such that an excess pull on the anchor line is effective to release the flukes of the anchor for at least substantial free pivoting movement. However, and most particularly in conjunction medium size boats which are not equipped with anchor winches, it is sometimes difficult to exert a manual pull on an anchor line in excess of that amount of pull which is to be overcome by the spring action associated with the stop structure.

In order to overcome this problem with existing anti-fouling anchors one form of anchor of &:he instant invention utilizes a tubular anchor rope having its lower end anchored relative to the anchor shank for a direct pull thereon and also utilizes a releasable stop structure actuating smaller diameter line passing downwardly through the tubular anchor line and secured to the operator of the stop structure for release thereof responsive to a pull on the smaller diameter line at a magnitude considerably less than the pull which may be exerted on the shank of the anchor by the tubular anchor line.

In addition, a further problem with anti-fouling anchors equipped with deactivatable stop structure limiting angular displacement of the flukes thereof is the fact that the deactivatable structure, in most cases, may not be reactivated after a fouled anchor is pulled from the bottom and before the anchor is pulled to the surface.

Accordingly, a second form of the instant invention incorporates an anchor line secured directly to the operator of the stop structure for release thereof from the surface, and both disclosed forms of anchor include structure enabling the stop structure to be reactuated once the anchor has been released from the bottom merely by spring structure incorporated into the anchor.

The main object of this invention is to provide an anti-fouling pivoted fluke equipped anchor including structure whereby the deactivatable stop structure for the anchor flukes may be deactivated from the surface of a body of water independent of a pull on the anchor line and independent of a separate line exterior of the anchor line for deactivating the stop structure.

Another important object of this invention is to provide an anti-fouling anchor in accordance with the preceding object and which may have its stop structure reactivated independent of the anchor being pulled to the surface for the purpose of manually reactivating the stop structure.

Yet another object of this invention is to provide an anti-fouling anchor wherein the stop structure for the pivoted flukes thereof is disposed exteriorly of the anchor shank for ease in visual inspection each time the anchor is raised to the surface.

Yet another object of this is to provide an anti-fouling anchor designed to provide bottom penetrating and holding power at least equivalent to the bottom penetrating and holding power of similar non anti-fouling anchors and yet which will be of reasonably light weight construction.

A final object of this invention to be specifically enumerated herein is to provide an anti-fouling anchor in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
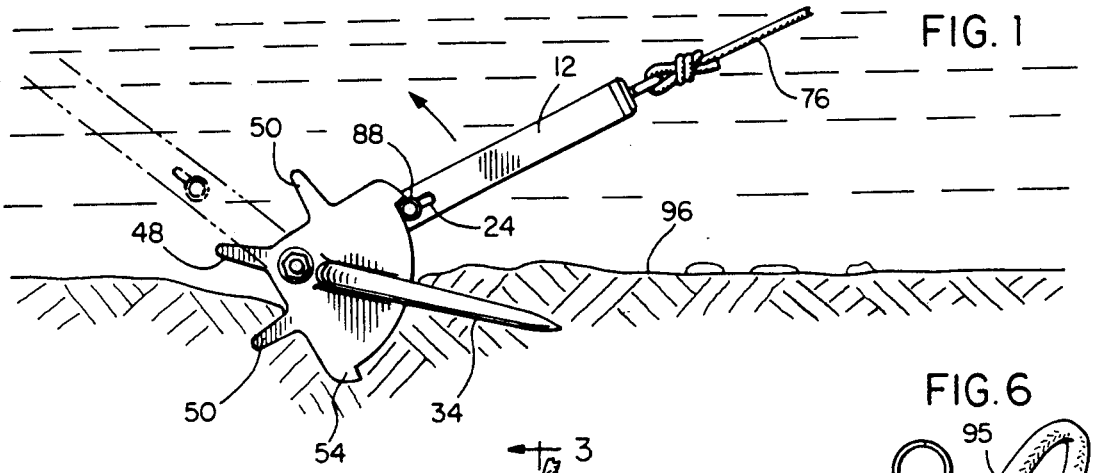
FIG. 1 is a side elevational view of a first form of the anchor of the instant invention operatively engaged with the bottom of a body of water and with an alternate release position of the shank of the anchor fragmentarily illustrated in phantom lines.

Referring now more specifically to the FIGS. 1–4, a first form of anchor constructed in accordance with the present invention is referred to in general by the reference numeral 10 and includes an elongated tubular shank 12 having first and second end portions 14 and 16, respectively. The second end portion 16 is removably plugged through the utilization of a shouldered sleeve 18 including a longitudinal bore 20 formed therethrough and held in place through the utilization of radial fasteners 22.

The tubular shank is rectangular in cross section (although a cylindrical tubular shank may be used) and includes opposite side longitudinal slots 24 formed therein approximately one-third the length of the sleeve 12 from the first end portion 14 thereof.

In addition, the lower first end portion 14 of the shank 12 includes diametrically opposite radial bores 26 formed therethrough and the lower end of the shank 12 is open.

A generally cylindrical bushing 28 extends through the bores 26 and projects slightly outward of the outer ends of the bores 26. The ends of the bushing 28 include diametrically opposite, axially projecting and sector shaped lugs 30 on each end and a pair of fluke assemblies referred to in general by the reference numerals 32 include conventional fluke portions 34 and generally sector shaped mounting plate portions 36 having registered small bores 38 formed therethrough whose inner ends are equipped with counter bores 40 provided with sector shaped recessed in which the lugs 30 are receivable and the mounting plate portions 36 are secured to opposite sides of the tubular sleeve 12 through the utilization of a pivot bolt 44 secured through the small bores 38 and the bushing 28, minimum spacing 46 being maintained between the inner sides of the mounting plate portions 36 and the opposing sides of the tubular sleeve 12.

The mounting plate portions 36 each include a first outwardly projecting arm 48 extending in a direction opposite to the direction in which the corresponding fluke 34 extends and a pair of opposite side outwardly projecting arms 50 for a purpose to be hereinafter more fully set forth. In addition, each of the mounting plate portions 36 includes a cylindrical surface 52 facing in the direction in which the corresponding fluke 34 extends and the opposite ends of each of the cylindrical surfaces 52 includes a stop lug 54 defining a stop or abutment face 56 extending generally radially of the corresponding bore 38 and a cam ramp surface 58.

The lugs 30 and recesses 40 interlock the mounting plate portions 36 and bushing 28 for simultaneous oscillation relative to the pivot bolt 44. In addition, the bushing 28 includes a longitudinally extending radial slot 60 on the right end thereof as seen in FIG. 2 and a coil spring 62 is disposed within the tubular sleeve 12 about the bushing 28 and has a first inwardly directed end 64 anchored in the slot 60 and a second end 66 extending upwardly within the tubular sleeve 12 to a point spaced closely beneath the lower ends of the slots 24, see FIG. 2.

Figure 2:
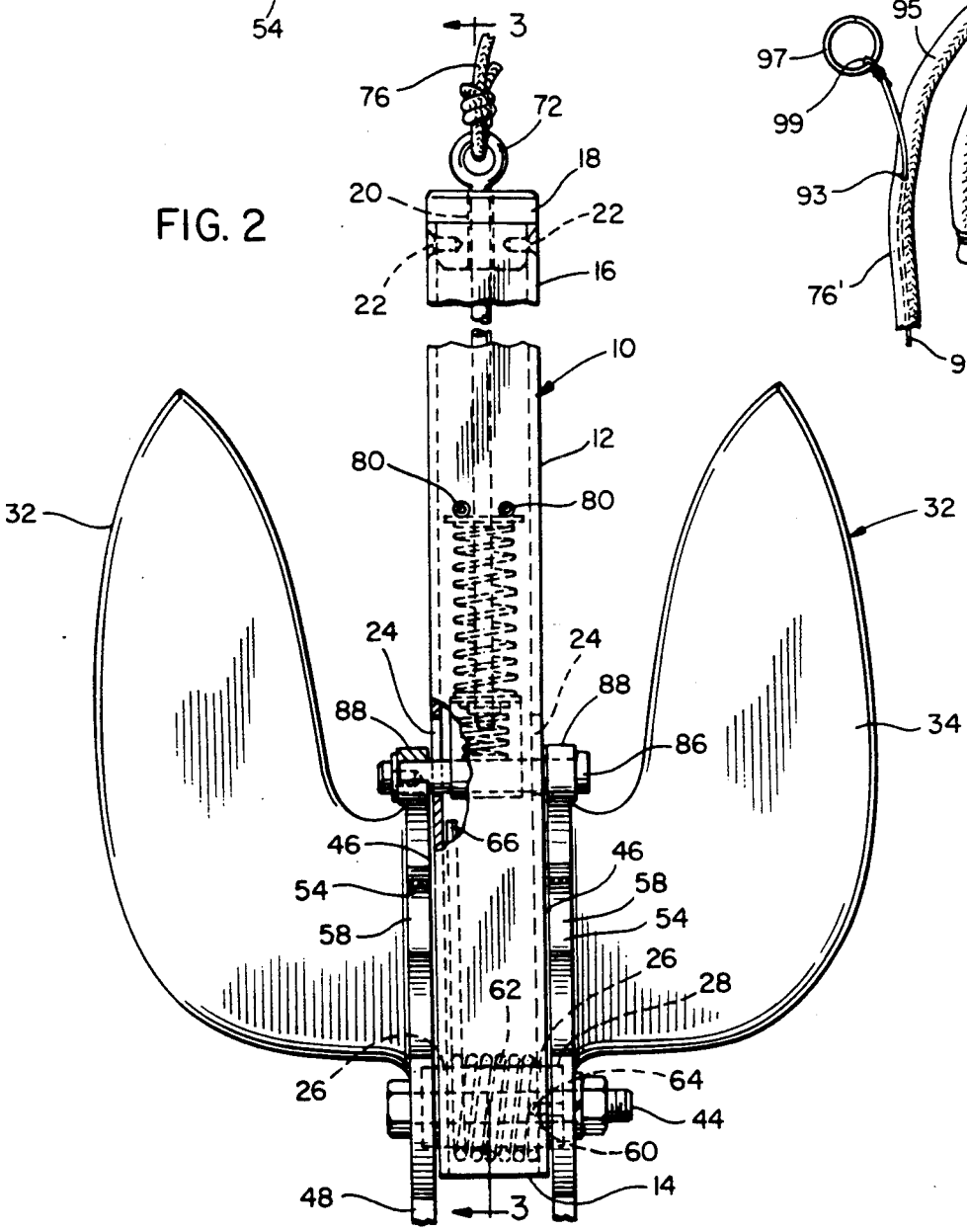
FIG. 2 is an enlarged front elevational view of the anchor with lower portions of the mounting plates for the flukes of the anchor broken away, central portions of the tubular shank of the anchor broken away and illustrated in vertical section and an upper length portion of the anchor shank broken away.
Figure 3:
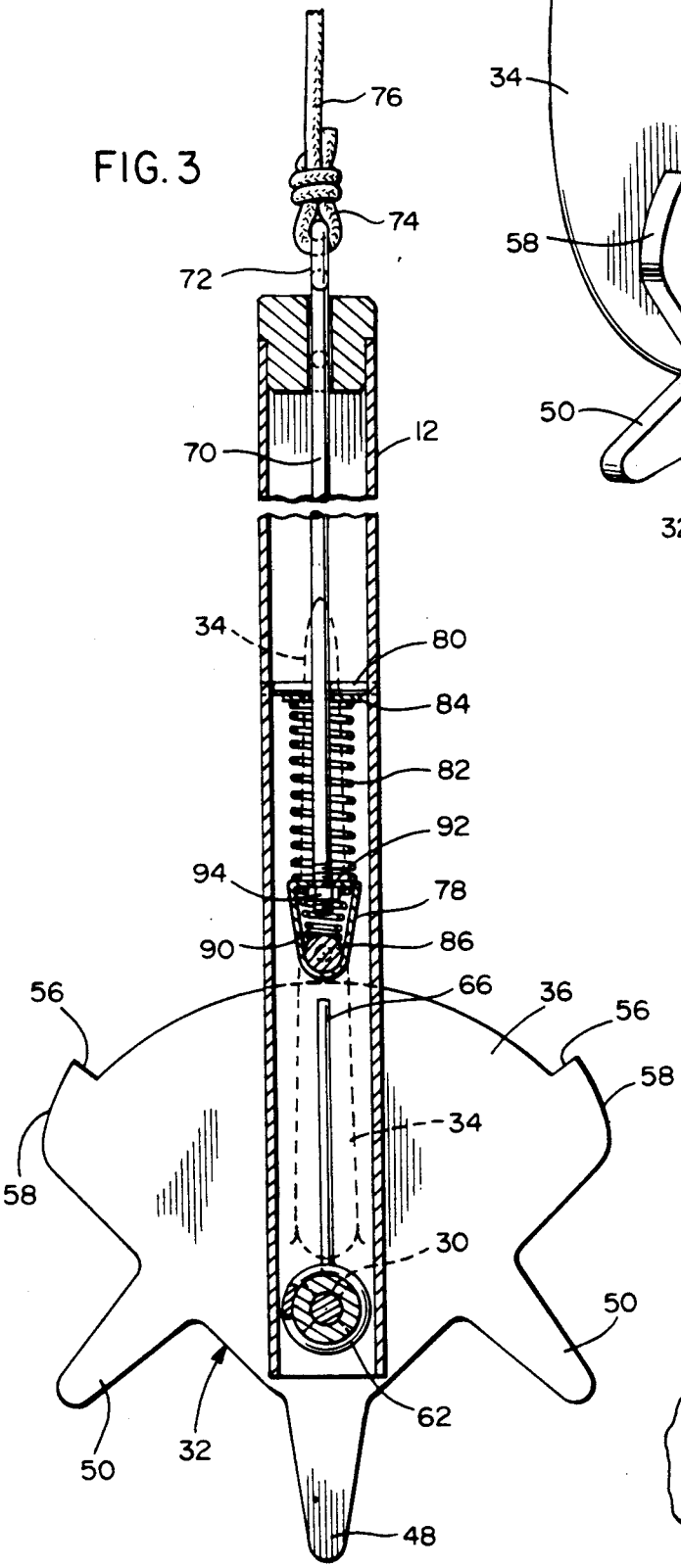
FIG. 3 is a vertical sectional view taken substantially upon the plane indicated by the section line 3—3 of FIG. 2.
Figure 4:
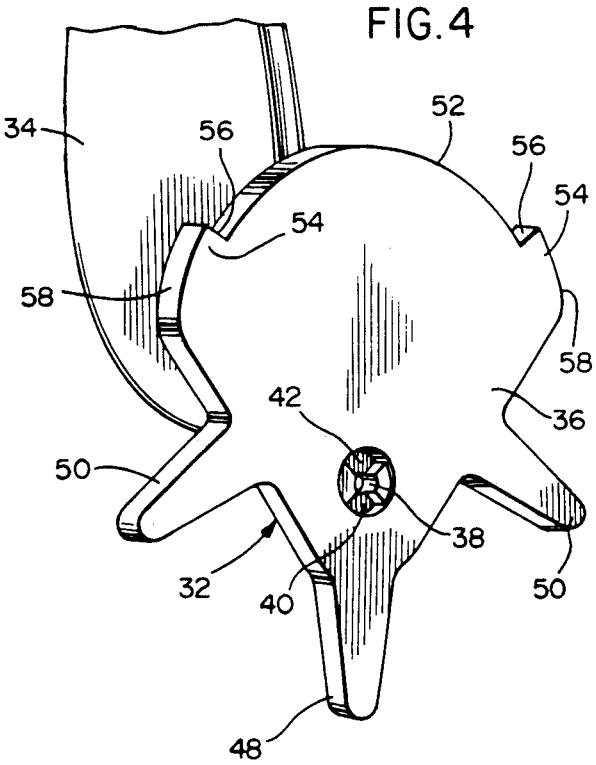
FIG. 4 is a fragmentary enlarged inside perspective view of one of the anchor fluke mounting plates and the associated anchor fluke portion.

With attention now invited more specifically to FIGS. 2 and 3, a latch operator rod 70 is slidably received through the bore 20 and includes an anchor eye 72 on its upper end to which one end 74 of an anchor rope 76 is anchored. The lower end of the latch operator rod 70 has a loop type connector 78 adjustably secured thereon and a longitudinal mid-portion of the rod 70 passes between a pair of abutment pins 80 secured through the tubular sleeve 12, a heavy compression spring 82 and washer 84 being disposed about the rod 70 immediately beneath the pin 80 and above the anchor loop 78. The compression spring 82 biases the anchor loop 78 downwardly within the sleeve 12.

A latch pin 86 extends through the slots 24 and has a pair of rollers 88 journaled on its opposite ends exteriorly of the sleeve 12 and registered and rollingly engaged with the surface 52. Still further, a light compression spring 90 is disposed within the anchor loop 78 and is interposed between the upper end of the anchor loop 78 and the longitudinal mid-portion of the pin 86 which extends through the lower portion of the anchor loop 78.

The lower end of the rod 70 is secured through an aperture 92 provided therefore in the upper end of the anchor loop 78 through the utilization of a nut 94 threadedly secured on the lower end of the rod 70. Accordingly, it may be seen that in order to raise the latch pin 86 in the slots 24 by an upward pull on the anchor rope 76, the upward pull must be in excess of the heavy downward thrust applied to the anchor loop 78 by the compression spring 82. However, the latch pin 86 may be shifted upwardly in the slots 24 by an upward push on the opposite ends of the latch pin 86 from there beneath with a force required only to overcome the biasing action of the light compression spring 90.

In its static position and when the flukes 34 generally parallel the tubular shank 12 and project toward the second end portion 16, the second end 66 of the spring 62 is generally centered, front to rear, in the tubular sleeve 12. Thus, the flukes 34 may pivot back and forth at least 10 degrees on either side of the centered positions of the flukes 34 illustrated in FIG. 3 before the second end 66 contacts either the front wall or the rear wall of the tubular sleeve 12. However, the stop surfaces 56 are engaged by the rollers 88 when the flukes 34 are angularly displaced approximately 40 degrees to either side of the center positions of the flukes illustrated in FIG. 3 and the stop surfaces 56 thereby limit angular displacement of the flukes 34 relatively to the shank 12.

When the anchor is in use in the manner illustrated in solid line in FIG. 1, a 45 degree downward inclination of the fluke portions 32 relative to the tubular shank 12 is sufficient to enable the fluke portions 32 to bite into the bottom 96, particularly if the anchor line 76 has sufficient length such that the tubular shank 12 may more closely parallel the surface of the bottom 96. The stops 54 and lower arms 50 serve to drag along the bottom 96 when the anchor 10 is first lowered to facilitate downward swinging of the fluke portions 34 so that they may bite into the bottom 96 and reach their full stop positions against a slight biasing action thereon by the spring 62. The anchor line 76 is able to withstand a considerable thereon by the associated boat (not shown) and thus to maintain the associated boat anchored. However, if the anchor 10 cannot be easily released from the bottom 96, a stronger pull is exerted upon the anchor rope 76 in order to move the pin 86 upwardly relative to the slots 24 and thus the rollers 88 out of registry with the stop surfaces 56 of the stops 54. Then, the tubular shank 12 may be swung to the phantom line position thereof illustrated in FIG. 12 and the fluke portions 34 will more easily release from the bottom 96.

Once the flukes 34 have been released from the bottom, the spring 62 will bias the fluke assembly 32 back toward its centered position with the cam ramp surfaces 58 acting upon the rollers 88 to cam the latch pin 86 upwardly along the slots 24 against the biasing action of the light spring 90 and relative to the anchor loop 78 and latch operator 70 to thus re-position the latch pin 86 between the stop surfaces 56.

The arms 48 and 50, when contacted with the bottom 96, ensure that the fluke assembly 32 will be pivoted from the center position illustrated in FIG. 2 to either of the operative positions such as that illustrated in FIG. 1 when it is desired to set the anchor and have the fluke portions 34 thereof bite into the bottom 96.

Thus, it may be seen that the heavy spring 72 may have as much as strength as desired to prevent the usual pull of a boat on the anchor rope 76 from raising the latch pin 86 from its operative position while a boat is anchored. However, a more than usual pull on the anchor rope 76 will be operative to raise the latch pin 86 against the biasing action of the compression spring 82 and thus enable the shank 12 to be swung form the solid line position thereof illustrated in FIG. 1. Further, once the anchor 10 has been disengaged from the bottom 96, the spring 30 will automatically swing the fluke assembly 32 back toward an operative position.

Figure 6:
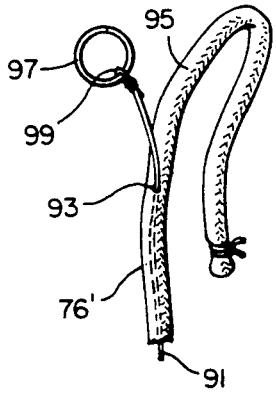
FIG. 6 is a fragmentary perspective view, on a reduced scale, of the upper end of the tubular anchor rope illustrated in FIG. 5.
Figure 5:
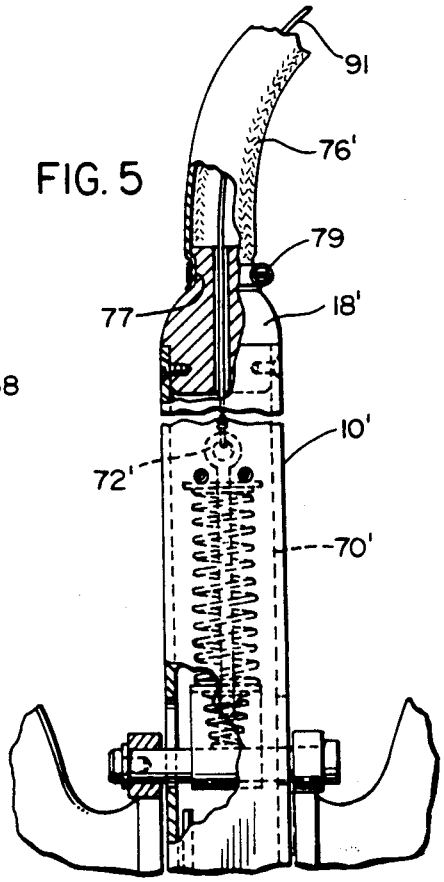
FIG. 5 is a fragmentary front elevational view of a second form of anchor utilizing a tubular anchor rope and an anchor fluke stop mechanism provided with a release cable slidingly received through the tubular anchor rope.

With attention now invited more specifically to FIGS. 5 and 6, the reference numeral 10' designates a modified form of anchor which is substantially identical to the anchor 10, except that the anchor rope 76' thereof has its lower end telescoped over and secured in a circumferential groove 77 formed in the outer surface of the upper end of the sleeve 18', a clamp 79 being used to retain the lower end of the anchor line 76' in the groove 77. In addition a small diameter flexible tension member in the form of a wire line 91 is slidingly received through all but the uppermost end portion of the tubular anchor line 76' with the lower end of the wire line 91 being anchored relative to the anchor eye 72' corresponding to the anchor eye 72 carried by the upper end of a foreshortened latch operator rod 70' corresponding to the latch operator 70. The upper end of the wire line 91 exits through a small opening 93 provided therefore immediately below the upper end portion 95 of the anchor line 76' and is equipped with a pull ring 97. Of course, the upper end portion 95 of the anchor line 91 may be as long as desired and will most certainly be of sufficient length to anchor relative to a boat cleat or the like. In addition it is noted that the opening 93 is merely a void between adjacent cross stands of the material of which the tubular anchor rope 91 is braided. Accordingly, the opening 93 may be effected at any point along the anchor line 76'. Still further, the upper end of the wire line 91 includes an anchor loop 99 of sufficiently small size to pass through the opening 93 and the ring 97 is a split ring and therefore may be removed from the anchor loop 99 if it is desired to shift the position of the opening 73 along the anchor line 76 through which the wire line 91 extends.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An anchor construction including an elongated shank having first and second end portions, a pair of anchor flukes pivotally supported from said first end portion on opposite sides thereof, for oscillation relative thereto about an axis transverse to said shank, between first positions with said flukes generally paralleling said shank and extending toward said second end portion of said shank and second positions disposed on opposite sides of shank and angularly displaced at least generally 135 degrees from said first positions, said flukes and shank including co-acting deactivatable cam and stop means operative to limit angularly displacement of said flukes away from said first positions to third positions angularly displaced at least generally 30 degrees from said first positions, said cam and stop means including latch means shiftable along said shank between applied and release positions and stop means carried by said flukes engagable by said latch means, when said latch means is in said applied position, to limit angularly displacement of said flukes from said first positions to said third positions, biasing means yielding biasing said latch means to said applied position, said latch means having one end of a pull line anchored relative thereto for exerting a manual pull on said latch means to shift the latter from said applied position to position to said release position, said latch means, when in said release position, being ineffective to limit movement of said flukes from said first positions to said third positions and thereby allowing said flukes to pivot past said third positions to said second positions thereof, said cam and stop means including cam means operative to cam said latch means, against the biasing action of said biasing means, from said applied position to said release position responsive to movement of said flukes from either second position to the corresponding third position for reactivating said stop means, and spring means operatively connected between said shank and flukes yieldingly biasing said flukes toward said first positions from said third and second positions, respectively.

2. The anchor construction of claim 1 wherein said latch means includes an operator shiftable along said shank between said applied and release positions and a latch member connected to said operator for movement therewith by a lost motion connection, said biasing means including heavy spring means biasing said operator toward said applied position and light spring means biasing said latch member relative to said operator in the same direction said heavy springs means biases said operator, said latch member being shiftable relative to said operator, against the biasing action of said light spring means, from said applied position to said release position independent of movement of said operator relative to said shank to thereby allow said spring means to pivot said flukes from said second positions past said third positions, said stop means including cam means operative, upon movement of said flukes from said second positions toward said third positions, to cam said latch member from said applied position to said release position.

3. The anchor construction of claim 2 wherein said heavy spring means biases said operator toward said one end of said shank.

4. An anchor construction including an elongated shank having first and second end portions, a fluke assembly, including fluke portions disposed on opposite sides of said shank, pivotally supported from said first end portion for oscillation relative thereto about an axis transverse to said shank between first retracted positions with said fluke portions generally paralleling said shank and extending toward said second end portion and release positions generally paralleling said shank and extending outward of said first end portion, said fluke assembly including combined cam and stop means and said shank including latch means shiftable relative to said shank between active and inactive positions and yieldingly biased toward said active position, said combined cam and stop means and said latch means coacting to limit substantially free oscillation of said fluke assembly relative to said shank between opposite operative positions of said fluke assembly in which said fluke portions are disposed to opposite sides of said shank and inclined outwardly therefrom toward said second end of said shank when said latch means is in said active position and being inoperative to limit oscillation of said fluke assembly relative to said shank when said latch means is in said inactive position, biasing means operatively connected between said fluke assembly and said shank biasing said fluke assembly back toward said retracted position from said release positions, said combined cam and stop means, during movement of said fluke assembly from said release position past said operative positions, being operative to cam said latch means from said active position toward said inactive position, said latch means including an operator therefore mounted from said shank for movement toward and away from said first end portion of said shank between active and inactive positions, respectively, said operator including means for anchoring one end of a pull line thereto, heavy spring means yielding biasing said operator toward its active position, means establishing a lost motion connection between said operator and said latch means, said latch means being biased toward the active position thereof relative to said operator through the utilization of light spring means.

5. An anchor construction including an elongated shank having first and second end portions, a fluke assembly, including fluke portions disposed on opposite sides of said shank, pivotally supported from said first end portion for oscillation relative thereto about an axis transverse to said shank between first retracted positions with said fluke portions generally paralleling said shank and extending toward said second end portion and release positions generally paralleling said shank and extending outward of said first end portion, said fluke assembly including combined cam and stop means and said shank including latch means shiftable relative to said shank between active and inactive positions and yieldingly biased toward said active position, said combined cam and stop means and said latch means coacting to limit substantially free oscillation of said fluke assembly relative to said shank between opposite operative positions of said fluke assembly in which said fluke portions are disposed to opposite sides of said shank and inclined outwardly therefrom toward said second end of said shank when said latch means is in said active position and being inoperative to limit oscillation of said fluke assembly relative to said shank when said latch means is in said inactive position, said combined cam and stop means, during movement of said fluke assembly from said release position past said operative positions, being operative to cam said latch means from said active position toward said inactive position, said latch means including an operator therefore mounted from said shank for movement toward and away from said first end portion of said shank between active and inactive positions, respectively, said operator including means for anchoring one end of a pull line thereto, heavy spring means yielding biasing said operator toward its active position, means establishing a lost motion connection between said operator and said latch means, said latch means being biased toward the active position thereof relative to said operator through the utilization of light spring means, said fluke assembly including opposite side plates disposed on opposite sides of said shank and from which said fluke portions are supported, said plates each including a pair of outwardly projecting arms remote from and oppositely inclined relative to said fluke portions and projecting outwardly from said shank first end portions, said arms being adapted to engage a bottom area, when said anchor is being moved across said bottom area and said fluke assembly is disposed between said release and operative positions, for effecting, by contact of said arms with said bottom, swinging of said fluke assembly toward and past said operative positions from said release positions.

* * * * *